US011305169B1

(12) United States Patent
Reynard

(10) Patent No.: US 11,305,169 B1
(45) Date of Patent: Apr. 19, 2022

(54) AQUATIC EXERCISE DEVICE

(71) Applicant: Geoffrey Eric Reynard, Columbus, OH (US)

(72) Inventor: Geoffrey Eric Reynard, Columbus, OH (US)

( * ) Notice: Subject to any disclaimer, the term of this patent is extended or adjusted under 35 U.S.C. 154(b) by 191 days.

(21) Appl. No.: 16/563,867

(22) Filed: Sep. 7, 2019

Related U.S. Application Data

(60) Provisional application No. 62/728,676, filed on Sep. 7, 2018.

(51) Int. Cl.
*A63B 69/12* (2006.01)
*A63B 23/12* (2006.01)

(52) U.S. Cl.
CPC ..... *A63B 69/12* (2013.01); *A63B 23/1218* (2013.01); *A63B 2208/03* (2013.01)

(58) Field of Classification Search
CPC . A63B 69/12; A63B 23/1218; A63B 2208/03; A63B 69/0057; A63B 22/02; A63B 21/068; A63B 23/0464; A63B 71/022; A63B 22/0605; A63B 21/0084; A63B 2225/50; A63B 2225/64; A63B 22/0023; A63B 2225/60; A63B 21/0004; A63B 1/00; A63B 21/00; A63B 2220/72; A63B 24/0087; A63B 71/0619; A47K 3/16; F24H 1/0081; A61H 2203/02; A61H 2201/10
See application file for complete search history.

(56) References Cited

U.S. PATENT DOCUMENTS

| | | | | | |
|---|---|---|---|---|---|
| 3,512,416 | A * | 5/1970 | Hohwart | A63B 69/12 | 73/379.09 |
| 3,724,012 | A * | 4/1973 | Sanderson | A63B 69/12 | 441/55 |
| 4,095,657 | A * | 6/1978 | Hohwart | A63B 69/12 | 434/254 |
| 4,529,192 | A * | 7/1985 | Stites | A63B 21/04 | 434/254 |
| 5,236,404 | A * | 8/1993 | MacLennan | A63B 69/12 | 434/254 |
| 7,104,932 | B1 * | 9/2006 | Brentlinger | A63B 69/12 | 434/254 |
| 7,175,569 | B1 * | 2/2007 | Lan | A63B 69/12 | 434/254 |
| 7,185,598 | B1 * | 3/2007 | Lan | A63B 69/12 | 114/215 |
| 2014/0155227 | A1 * | 6/2014 | Bellerive | A63B 69/12 | 482/55 |

* cited by examiner

*Primary Examiner* — Andrew S Lo
*Assistant Examiner* — Andrew M Kobylarz
(74) *Attorney, Agent, or Firm* — The Law Office of Patrick F. O'Reilly III, LLC

(57) ABSTRACT

According to a first embodiment of the present application, Applicant discloses an aquatic exercise device for assisting a swimmer to practice swimming in place. The device comprises: a pair of tines, each tine comprising an upper end and a lower end; a fork root attached to the upper ends of the pair of tines; and a suspension element attached to and suspending the fork root. The suspension element suspends the fork root and the upper ends of the tines above water comprising a practice area, the lower ends of the tines are submerged in the water of the practice area, and the pair of tines operative to maintaining a position of the swimmer in the practice area.

18 Claims, 13 Drawing Sheets

Detail "A"

AQUATIC EXERCISE DEVICE

CROSS-REFERENCE TO RELATED APPLICATIONS

This patent application claims priority to, and incorporates by reference in its entirety, U.S. Provisional Patent Application No. 62/728,676, entitled "Aquatic Exercise Device", filed on Sep. 7, 2018.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

Technical Field

The present invention generally relates to exercise devices. More particularly, the present invention relates to a device for assisting one to exercise in the water.

Background and Description of Related Art

Devices for assisting an individual to participate in water-related physical fitness activities are well known. Common devices include floatation devices, water weights, body boards, and under water fitness cycles. Such devices are generally intended to utilize the surrounding water's mass as a resistance to muscle motion or as a stabilizing factor for the person exercising.

Typically, when an exercise device assists a person with swimming, a large portion of a pool or other body of water is necessary to perform the swimming exercise. Accordingly, there is a need for an aquatic exercise device that allows a swimmer to practice swimming in place, or otherwise limits the amount of space needed for a person to perform swimming exercises.

SUMMARY OF EXAMPLE EMBODIMENTS

Accordingly, the present invention is directed to an aquatic exercise device that allows a swimmer to practice swimming in place, thereby substantially obviating one or more problems resulting from the limitations and deficiencies of the related art.

According to a first embodiment of the present application, Applicant discloses an aquatic exercise device for assisting a swimmer to practice swimming in place. The device comprises: a pair of tines, each tine comprising an upper end and a lower end; a fork root attached to the upper ends of the pair of tines; and a suspension element attached to and suspending the fork root. The suspension element suspends the fork root and the upper ends of the tines above water comprising a practice area, the lower ends of the tines are submerged in the water of the practice area, and the pair of tines is operative to maintain a position of the swimmer in the practice area.

According to a second embodiment of the present application, Applicant discloses an aquatic exercise device for assisting a swimmer to practice swimming in place. The device comprises: a pair of tines, each tine comprising an upper end and a lower end; a pair of retention elements, the retention elements respectively attached to the upper ends of the tines; a fork root attached to the upper ends of the pair of tines using the respective retention elements; and a suspension element attached to and suspending the fork root. The suspension element suspends the fork root and the upper ends of the tines above water comprising a practice area, the lower ends of the tines are submerged in the water of the practice area, the pair of tines is operative to maintain a position of the swimmer in the practice area, and each retention element applies a normalizing force to maintain the position of each tine with respect to the fork root.

According to a third embodiment of the present application, Applicant discloses an aquatic exercise device for assisting a swimmer to practice swimming in place. The device comprises: An aquatic exercise device for assisting a swimmer to practice swimming in place, said device comprising: a pair of tines, each tine comprising an upper end and a lower end; a pair of retention elements, the retention elements respectively attached to the upper ends of the tines; a fork root attached to the upper ends of the pair of tines using the respective retention elements; a suspension element comprising a first end and a second end, the suspension element attached to and suspending the fork root at the first end of the suspension element; and a base attached to the second end of the suspension element. The suspension element suspends the fork root and the upper ends of the tines above water comprising a practice area, the lower ends of the tines are submerged in the water of the practice area, the pair of tines is operative to maintain a position of the swimmer in the practice area, and each retention element applies a normalizing force to maintain the position of each tine with respect to the fork root.

BRIEF DESCRIPTION OF THE DRAWINGS

The invention will now be described, by way of example, with reference to the accompanying drawings, which are incorporated in and constitute a part of the specification, in which.

DRAWING REFERENCE NUMERALS

Figure 1:
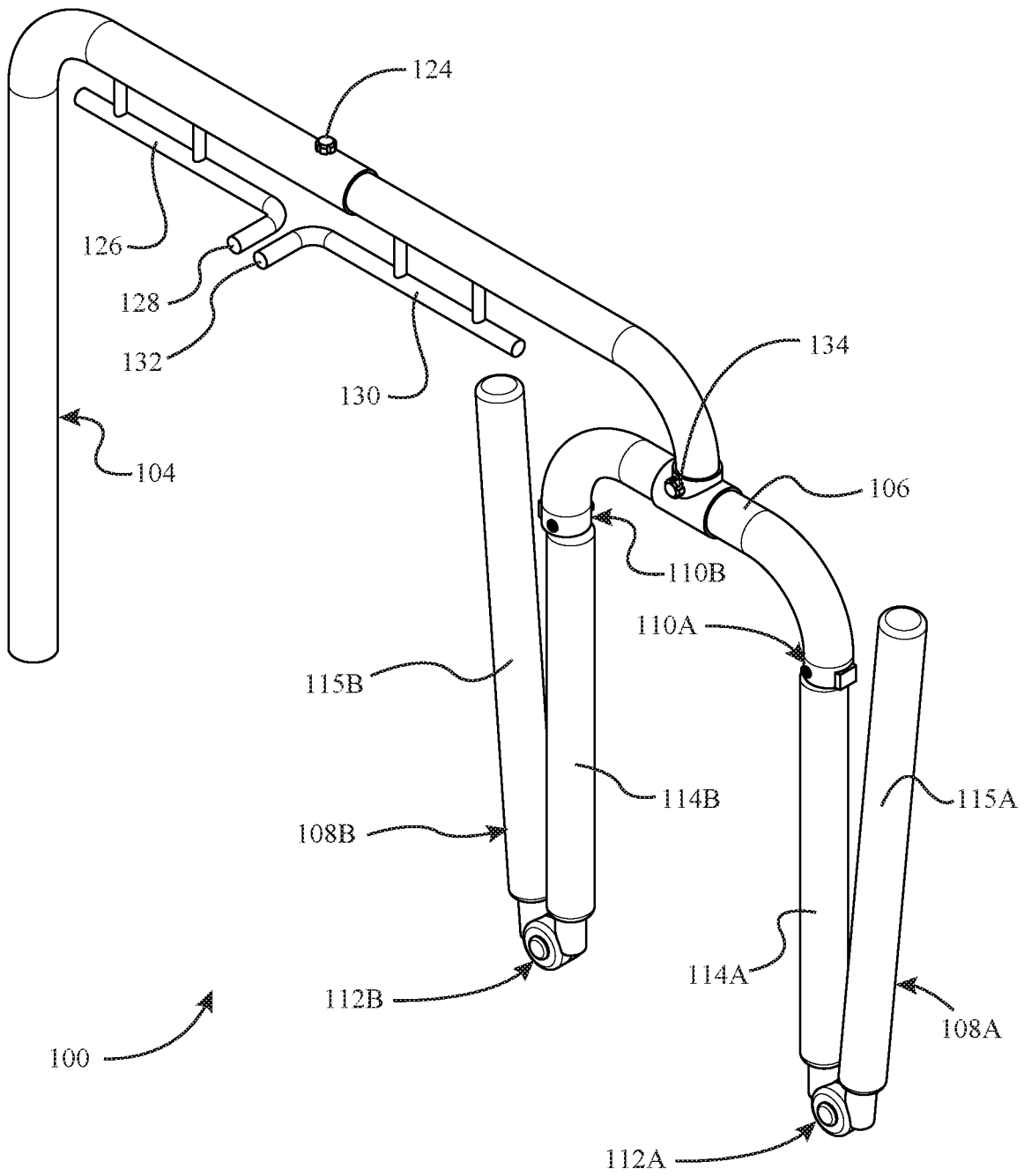
FIG. 1 is a perspective view of the example aquatic exercise device, wherein each of the lower tine portions is in a folded position.

The following reference characters identify the associated elements depicted in the drawings describing the present invention:

| | |
|---|---|
| 100 | Aquatic Exercise Device |
| 102 | Base |
| 104 | Suspension Element |
| 106 | Fork Root |
| 108A | Tine |
| 108B | Tine |
| 110A | Retention Element |
| 110B | Retention Element |
| 112A | Hinge |
| 112B | Hinge |
| 114A | Upper Protective Covering |
| 114B | Upper Protective Covering |
| 115A | Lower Protective Covering |
| 115B | Lower Protective Covering |
| 116 | Fastener |
| 118 | Spring |
| 120 | Inverted L-Shaped Pipe Member of Suspension Element |
| 122 | Horizontal Pipe Member of Suspension Element |
| 124 | Fastener Member of Suspension Element |
| 126 | First Pull-Up Bar |
| 128 | Open End of First Pull-Up Bar |
| 130 | Second Pull-Up Bar |
| 132 | Open End of Second Pull-Up Bar |
| 134 | Fastener Member of Fork Root |

-continued

| | |
|---|---|
| 136 | Plate of Retention Element |
| 138A | Upper Pipe Member of Tine |
| 138B | Upper Pipe Member of Tine |
| 140A | Lower Pipe Member of Tine |
| 140B | Lower Pipe Member of Tine |
| 142A | Upper Section of Hinge |
| 142B | Upper Section of Hinge |
| 144A | Lower Section of Hinge |
| 144B | Lower Section of Hinge |
| 146A | Hinge Pin |
| 146B | Hinge Pin |
| 148 | Pool Deck |
| 150 | Anchor Sleeve in Pole Deck |
| 152 | Pool Water |
| 154A | Direction of Rotation of Lower Pipe Member of Tine |
| 154B | Direction of Rotation of Lower Pipe Member of Tine |
| 156 | User of Aquatic Exercise Device |
| 158A | Outward Rotation of Tine |
| 158B | Outward Rotation of Tine |
| 160 | Arrow Denoting Horizontal Adjustability |
| 162 | Arrow Denoting Swiveling of Tines |
| 164 | Base Sleeve Fastener |
| 166 | Person Using Pull-Up Bars |

DETAILED DESCRIPTION

Referring now to FIG. 1, there is shown a perspective view of an example aquatic exercise device 100. Example device 100 may comprise a base 102 (see FIG. 16) and a suspension element 104 for securing one end of the device 100 to a location near a water-filled exercise area. In an alternate embodiment, base 102 may be operative to enable suspension element 104 to be rotated between a first position in which the upper portion of suspension element 104 extends over land adjacent to base 102 and a second position in which the upper portion of suspension element 104 extends over a practice area filled with water. In a further alternate embodiment, base 102 may removably receive suspension element 104 (see FIG. 16), thereby enabling the rest of device 100 to be removed and/or stored. The sleeve of the base 102 may comprise a thumb screw-type fastener 164 that can be loosened in order to remove the suspension element 104 of the device 100 from the base 102 (refer to FIG. 16).

Figure 8:
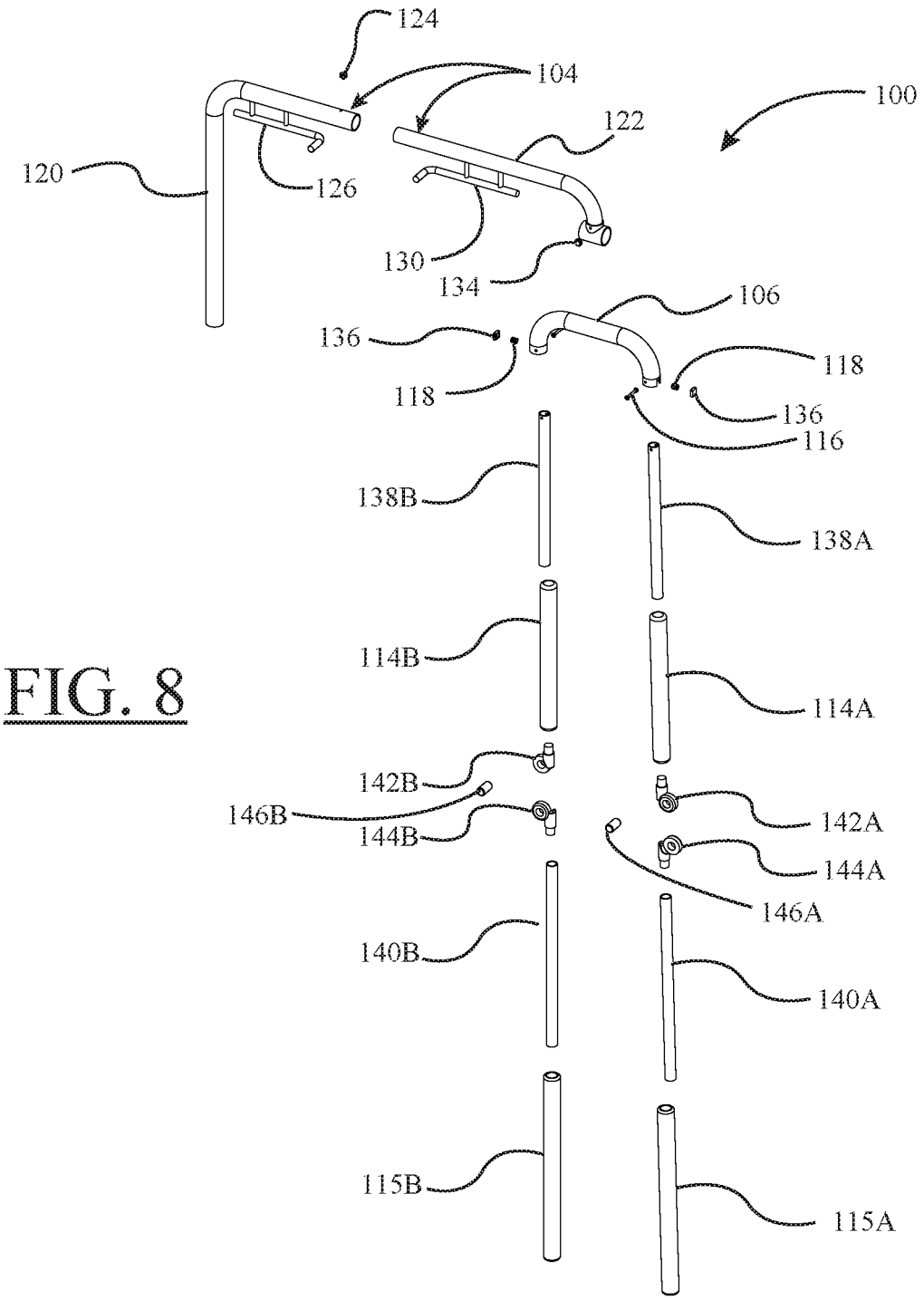
FIG. 8 is an exploded perspective view of the example aquatic exercise device of FIG. 1.
Figure 14:
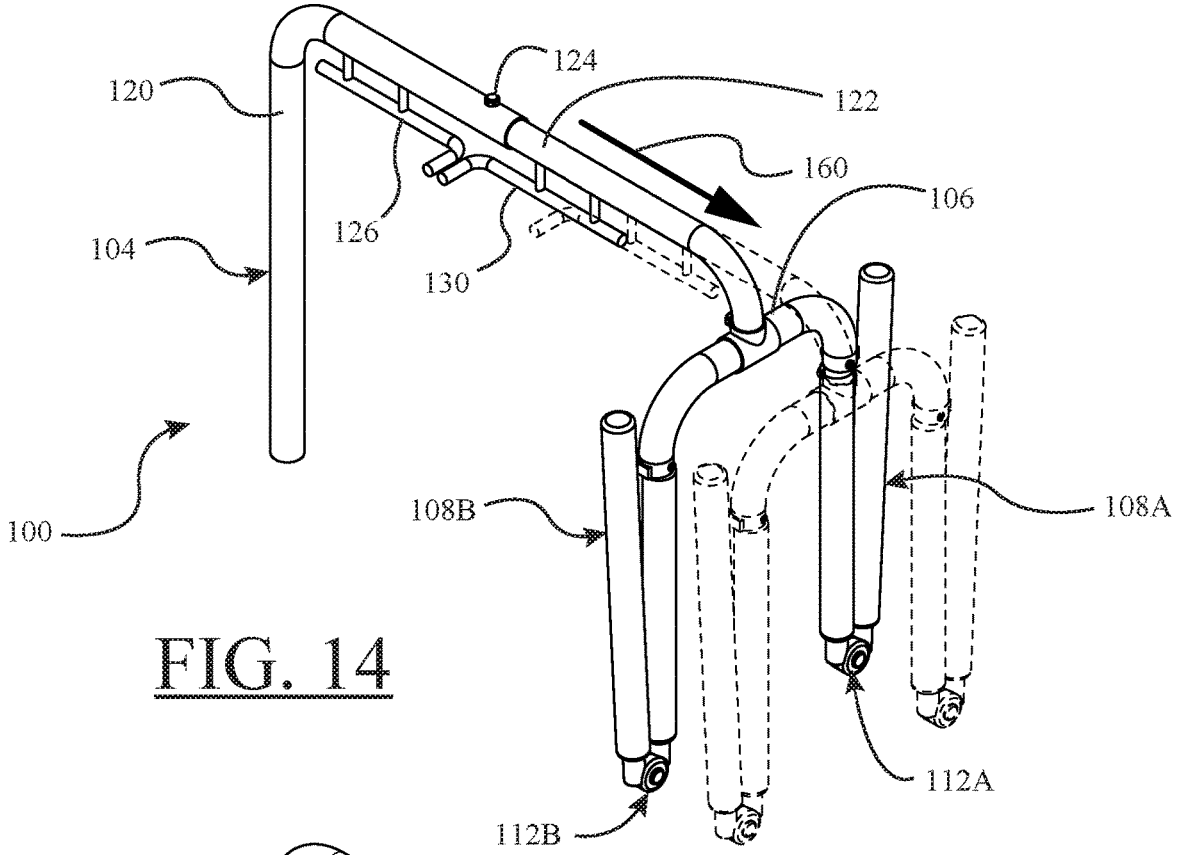
FIG. 14 is still another perspective view of the example aquatic exercise device of FIG. 1, wherein the horizontal adjustment of the suspension element of the example aquatic exercise device is illustrated.

In the example embodiment, with combined reference to FIGS. 1 and 8, it can be seen that the suspension element 104 of the aquatic exercise device 100 comprises an inverted L-shaped pipe member 120 and a horizontal pipe member 122. As shown in FIG. 14, the horizontal pipe member 122 is slidably adjustable relative to the top section of the inverted L-shaped pipe member 120 (as diagrammatically indicated by the arrow 160 in FIG. 14). The top section of the inverted L-shaped pipe member 120 may comprise a thumb screw-type fastener 124 that can be loosened in order to allow the horizontal pipe member 122 to slide relative to the top section of the inverted L-shaped pipe member 120, and then tightened in order to fix the position of the horizontal pipe member 122 relative to the top section of the inverted L-shaped pipe member 120. In the example embodiment, the inverted L-shaped pipe member 120 may be formed from a pipe having an outside diameter of approximately 2 inches, while the horizontal pipe member 122 may be formed from a pipe having an outside diameter of slightly less than 2 inches to enable its telescopic adjustment within the top section of the inverted L-shaped pipe member 120. In one embodiment, the combined horizontal portion of suspension element 104 may be 45-60 inches long in order to provide a sufficiently wide practice area. The vertical portion of suspension element 104 extending from base 102 may vary in length depending on the water level in the practice area. Also, in other embodiments, the vertical section of the inverted L-shaped pipe member 120 of the suspension element 104 may include a mechanism for varying its height in order to customize aquatic exercise device 100 for a particular environment, similar to that provided for the horizontal adjustment of the suspension element 104.

In an alternative embodiment, the suspension element 104 may be constructed from a single aluminum pipe having an outside diameter of approximately 2 inches, and it may be bent as illustrated in the example embodiment. That is, in this alternative embodiment, the horizontal and vertical portions of suspension element 104 may have a single unitary construction.

Figure 10:
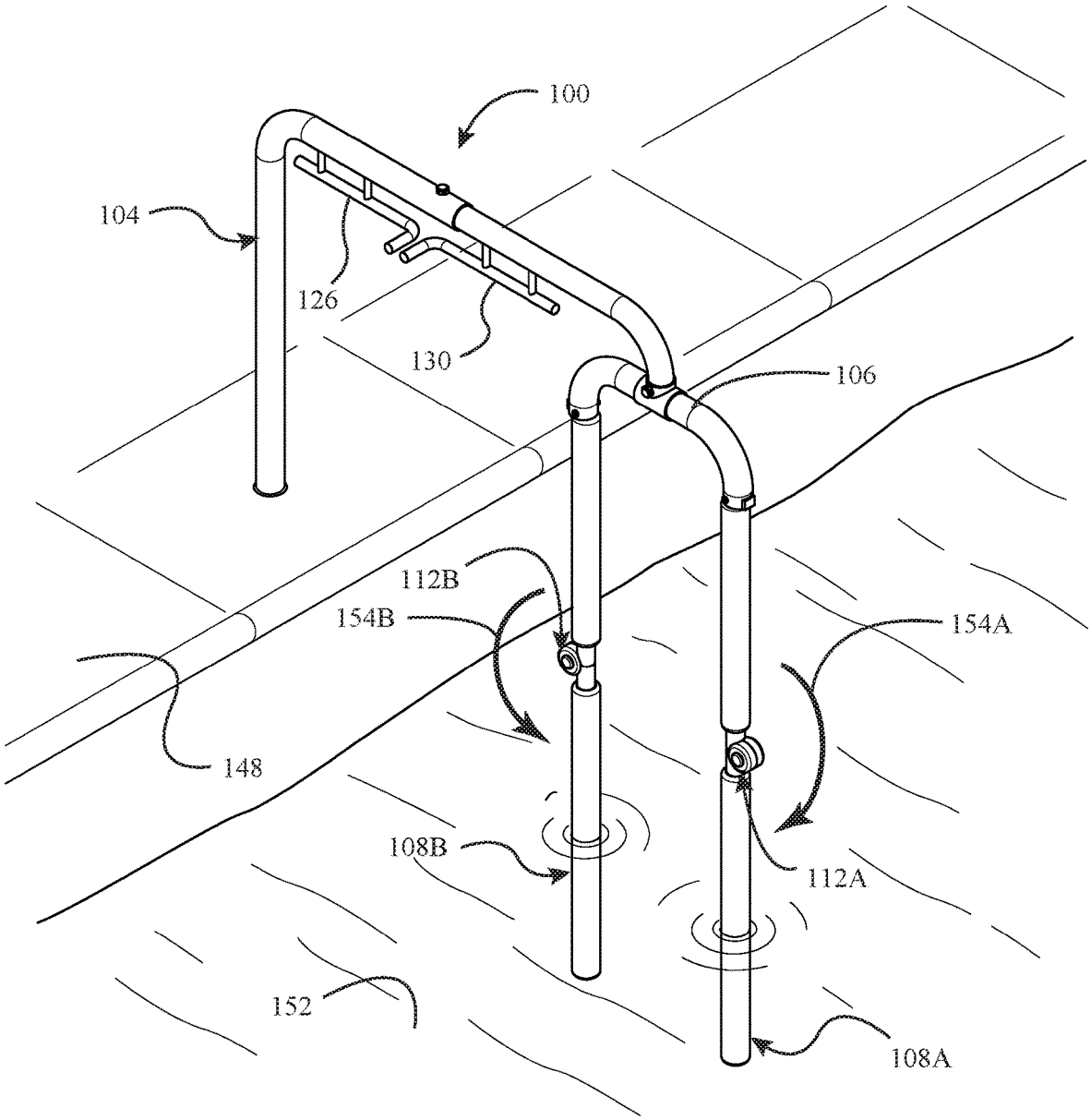
FIG. 10 is yet another perspective view of the example aquatic exercise device of FIG. 1, wherein the aquatic exercise device has been mounted into the sleeve-type anchor on the pool deck and the lower tine portions of the aquatic exercise device have been rotated into their operative, extended positions.

Suspension element 104 is operative to retain and suspend a fork root 106 above a practice area within which a swimmer may practice swimming and/or otherwise exercise (e.g., see FIGS. 1 and 10). In the illustrated embodiment, the vertical portion of suspension element 104 from which fork root 106 is suspended is approximately 4 inches long. Further, in the illustrated embodiment, fork root 106 is a separate component from the suspension element 104, but other embodiments in which fork root 106 is integral with the suspension element 104 are envisioned.

Figure 12:
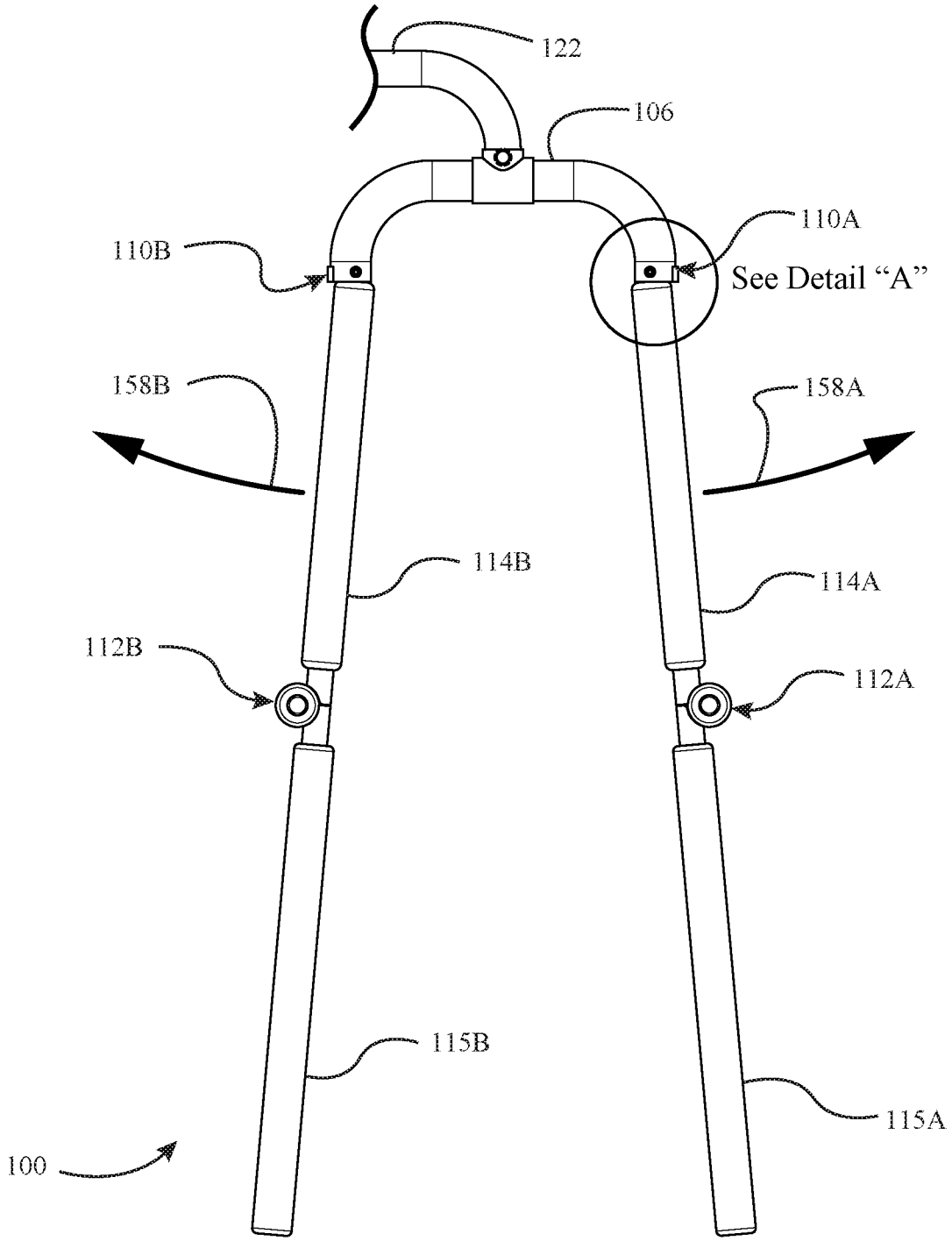
FIG. 12 is an enlarged view of the tine and root fork portion of the example aquatic exercise device depicted in FIG. 1.

Fork root 106 is operative to suspend two tines 108A and 108B (e.g., see FIGS. 1 and 12). The tines 108A and 108B are attached to fork root 106 using retention elements 110A and 110B, respectively. As shown in the example embodiment of FIGS. 1 and 12, together the fork root 106 and the tines 108A and 108B form an inverted yoke member. In the example embodiment, fork root 106 spaces the upper ends of tines 108A and 108B apart by 12 inches, although alternatives will be appreciated by those of ordinary skill in the art. The attachment mechanism employed by the illustrated embodiment is shown in enlarged Detail "A", and is described in more detail below with reference to FIG. 13.

Figure 15:
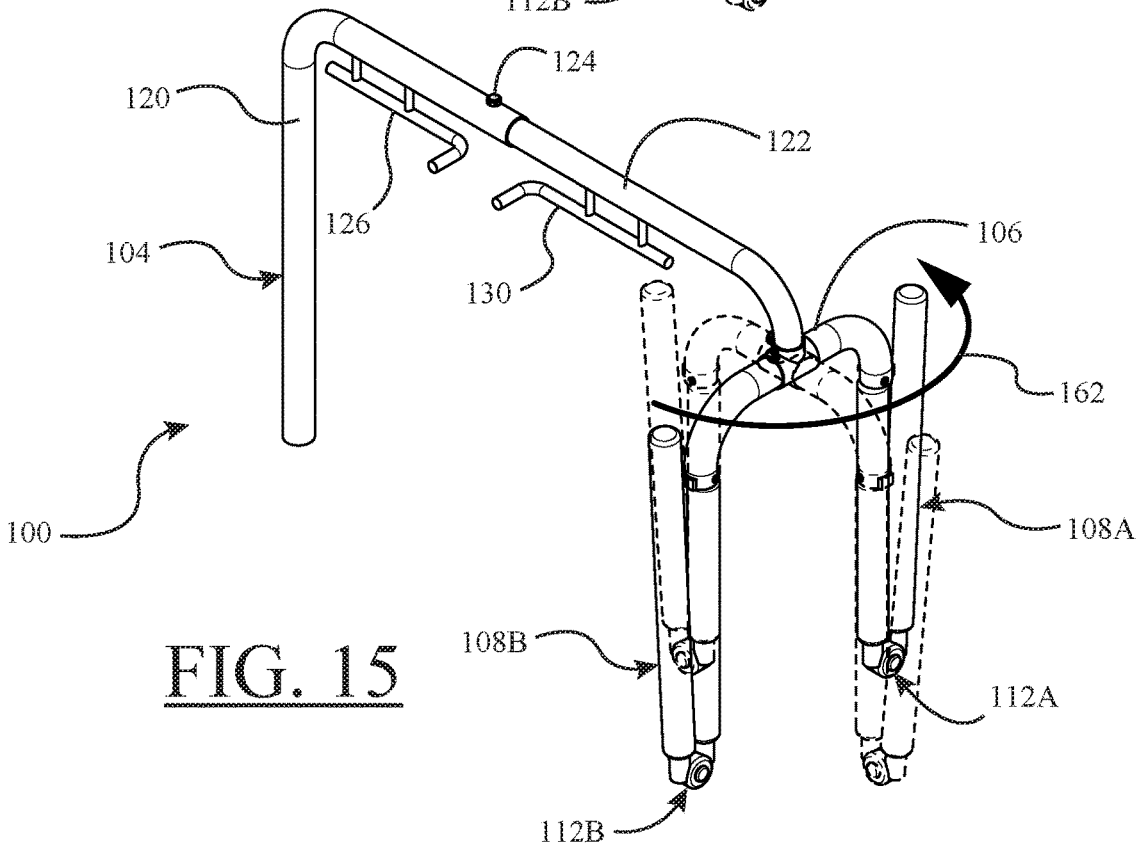
FIG. 15 is yet another perspective view of the example aquatic exercise device of FIG. 1, wherein the rotational adjustment of the tine and root fork portion of the example aquatic exercise device is illustrated.

As shown in the illustrated embodiment of FIG. 15, the fork root 106 and the tines 108A and 108B of the aquatic exercise device 100 may be rotatably adjustable relative to the suspension element 104 of the device 100 (the rotation of the fork root 106 and the tines 108A and 108B is diagrammatically represented by the curved arrow 162 in FIG. 15). As shown in FIG. 1, the tee fitting at the bent end of the horizontal pipe member 122 of the suspension element 104 may comprise a thumb screw-type fastener 134 that can be loosened in order to allow the fork root 106 and the tines 108A and 108B to rotate relative to the suspension element 104, and then tightened in order to fix the position of the fork root 106 and the tines 108A and 108B relative to the suspension element 104.

With reference again to FIGS. 1 and 8, each of tines 108A and 108 may comprise polyvinyl chloride (PVC) pipes having outside diameters of one inch, and each tine 108A, 108B may comprise an upper pipe member 138A, 138B and a lower pipe member 140A, 140B. The tines 108A and 108B are attached to fork root 106 at their upper ends, and in the operative configuration of the aquatic exercise device 100 (see FIG. 10), the lower ends of tines 108A and 108B descend into water 152 in the practice area of the pool (the rotation of the lower sections of the tines 108A, 108B into their operative positions is diagrammatically represented by the curved arrows 154A, 154B in FIG. 10). In the illustrated embodiment, each tine is approximately 52 inches long, but tines of other lengths are envisioned, including tines which may comprise a mechanism for customizing the length.

Figure 2:
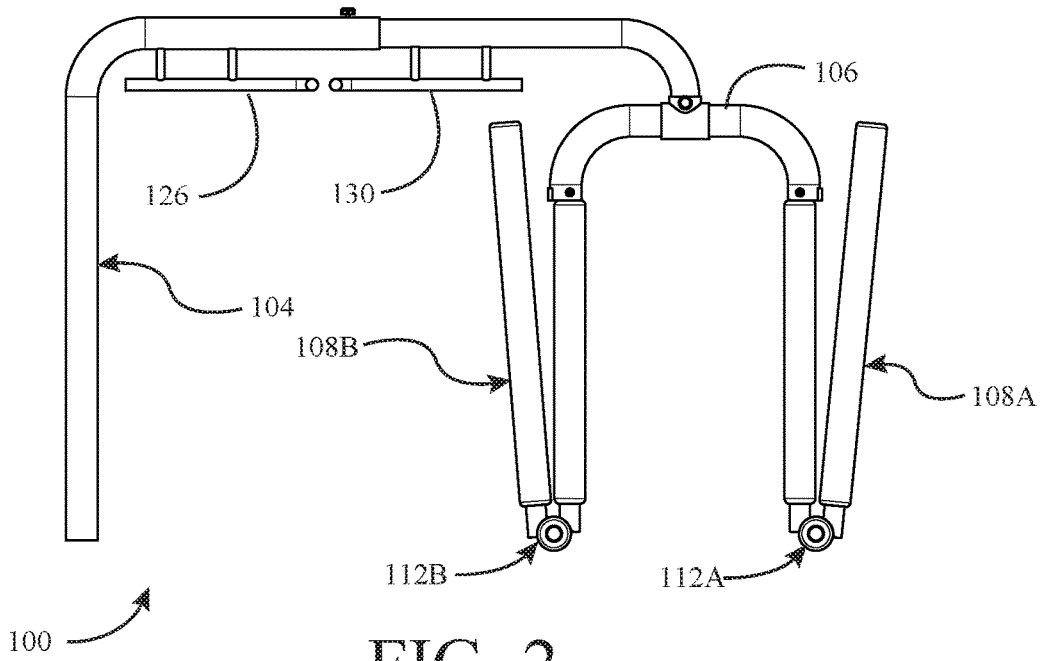
FIG. 2 is a front side view of the example aquatic exercise device of FIG. 1.
Figure 3:
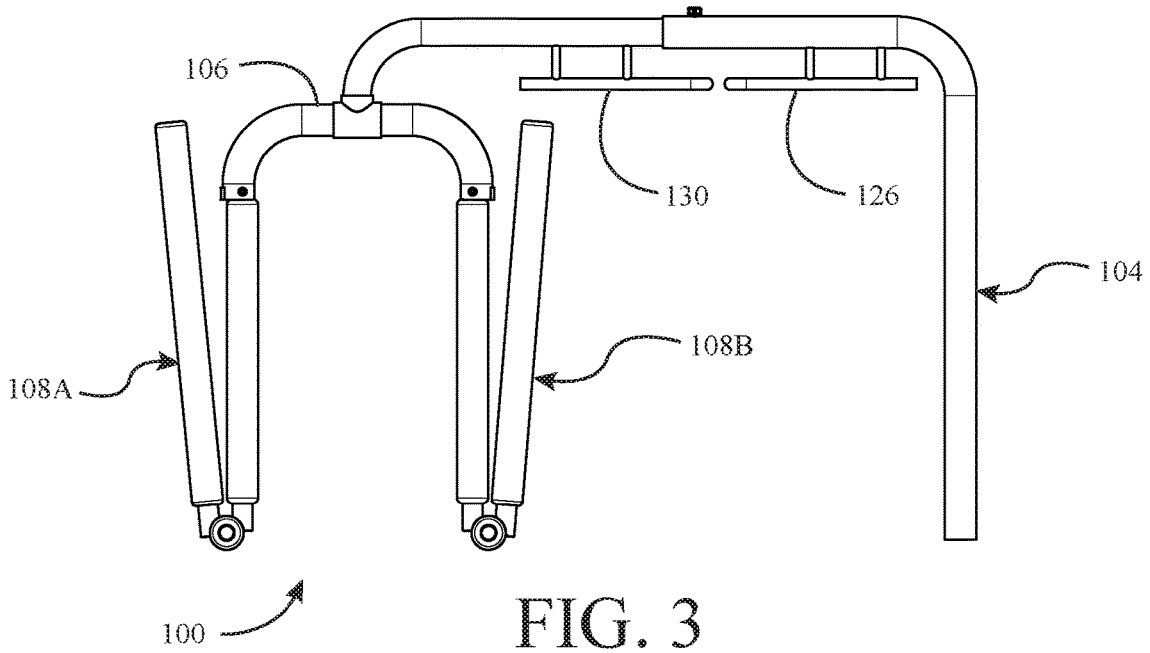
FIG. 3 is a rear side view of the example aquatic exercise device of FIG. 1.
Figure 4:
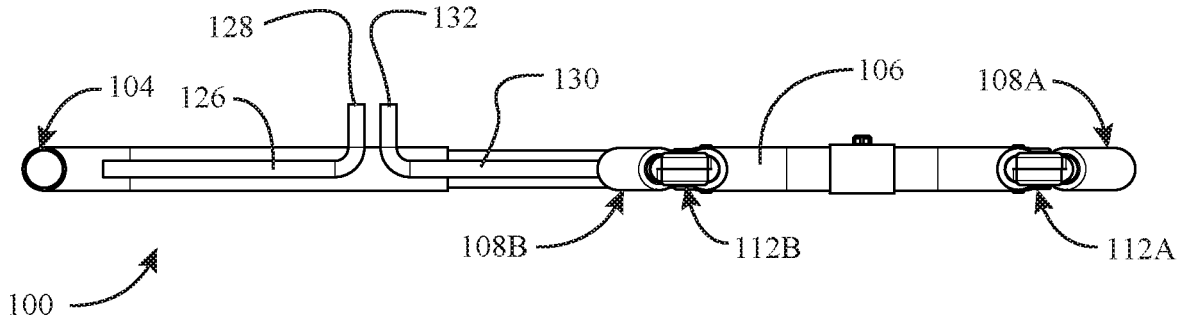
FIG. 4 is a bottom plan view of the example aquatic exercise device of FIG. 1.
Figure 5:
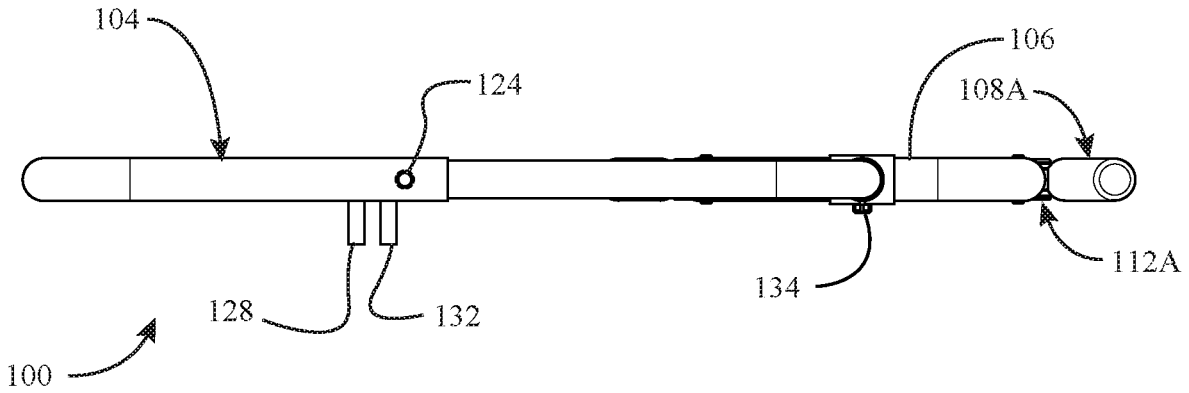
FIG. 5 is a top plan view of the example aquatic exercise device of FIG. 1.
Figure 6:
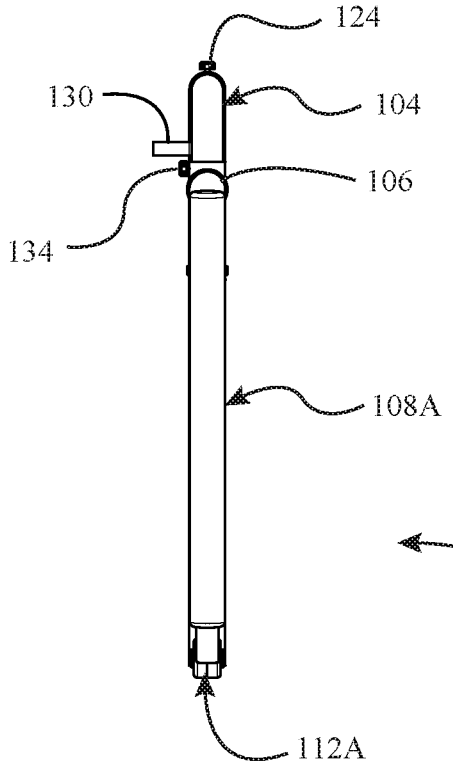
FIG. 6 is a first end view of the example aquatic exercise device of FIG. 1.
Figure 7:
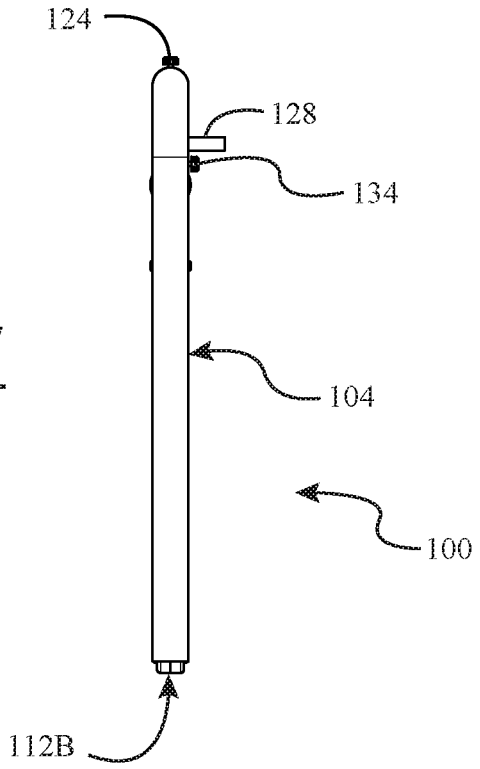
FIG. 7 is a second end view of the example aquatic exercise device of FIG. 1.

The tines 108A and 108B optionally comprise hinges 112A and 112B enabling each tine to be folded upon itself (see FIGS. 1-3), thereby removing the lower end from the water of the practice area and making the tines more compact. The upper and lower portions of tines 108A and 108B may comprise protective coverings. In the illustrated embodiment, the upper pipe members 138A, 138B are provided with protective coverings 114A, 114B (refer to FIGS. 1 and 8). Similarly, in the illustrated embodiment, the lower pipe members 140A, 140B are provided with protective coverings 115A, 115B (see FIGS. 1 and 8).

In the illustrated embodiment, with combined reference to FIGS. 1 and 8, it can be seen that the hinges 112A and 112B of the tines 108A and 108B may each comprise a upper hinge section 142A, 142B that is pivotally connected to a lower hinge section 144A, 144B by respective hinge pins 146A, 146B. As one example, ratchet elbow hinges may be used for the tine hinges 112A, 112B in one or more embodiments.

Figure 11:
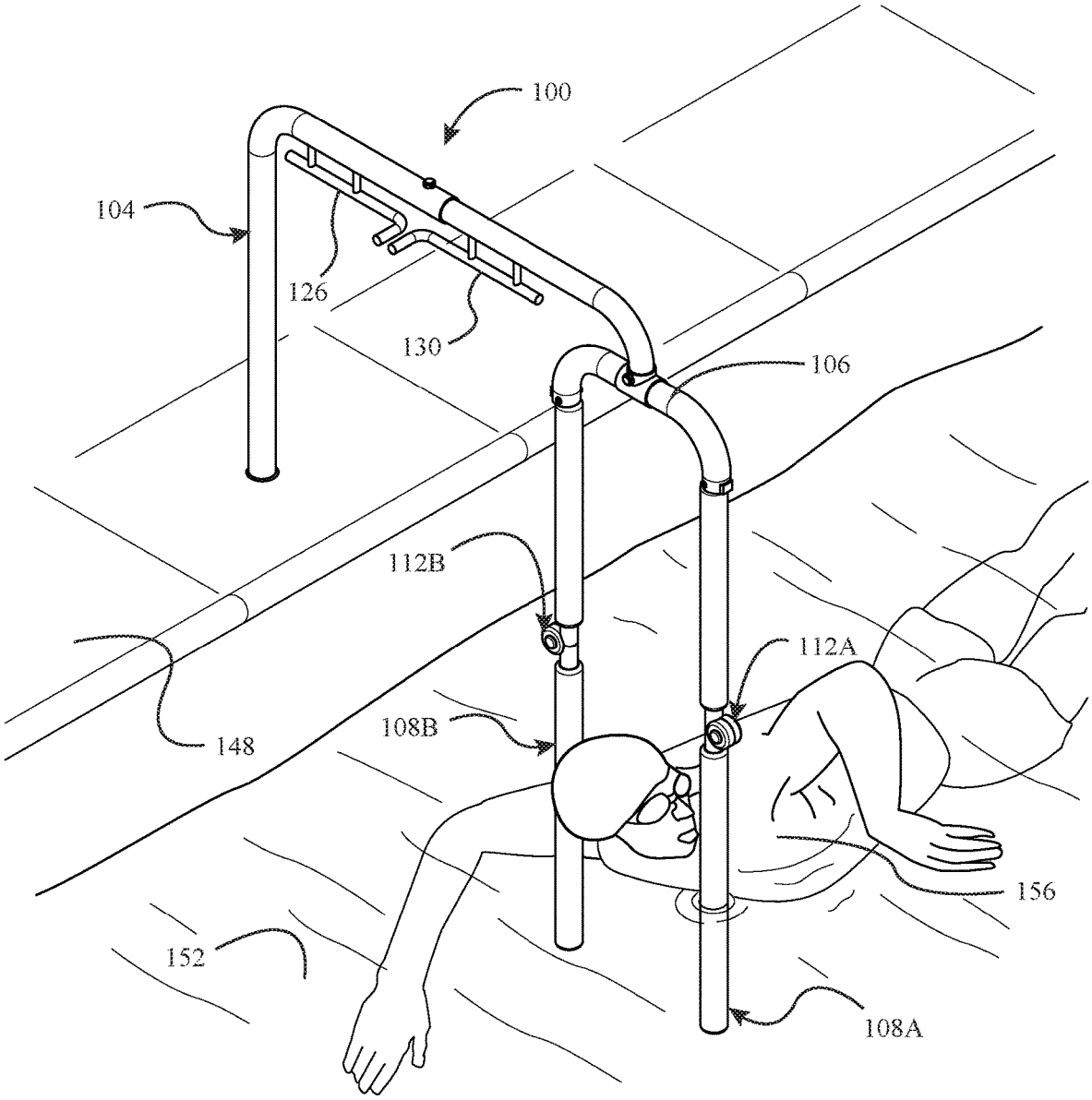
FIG. 11 illustrates a user swimming in place using the example aquatic exercise device of FIG. 1.
Figure 13:
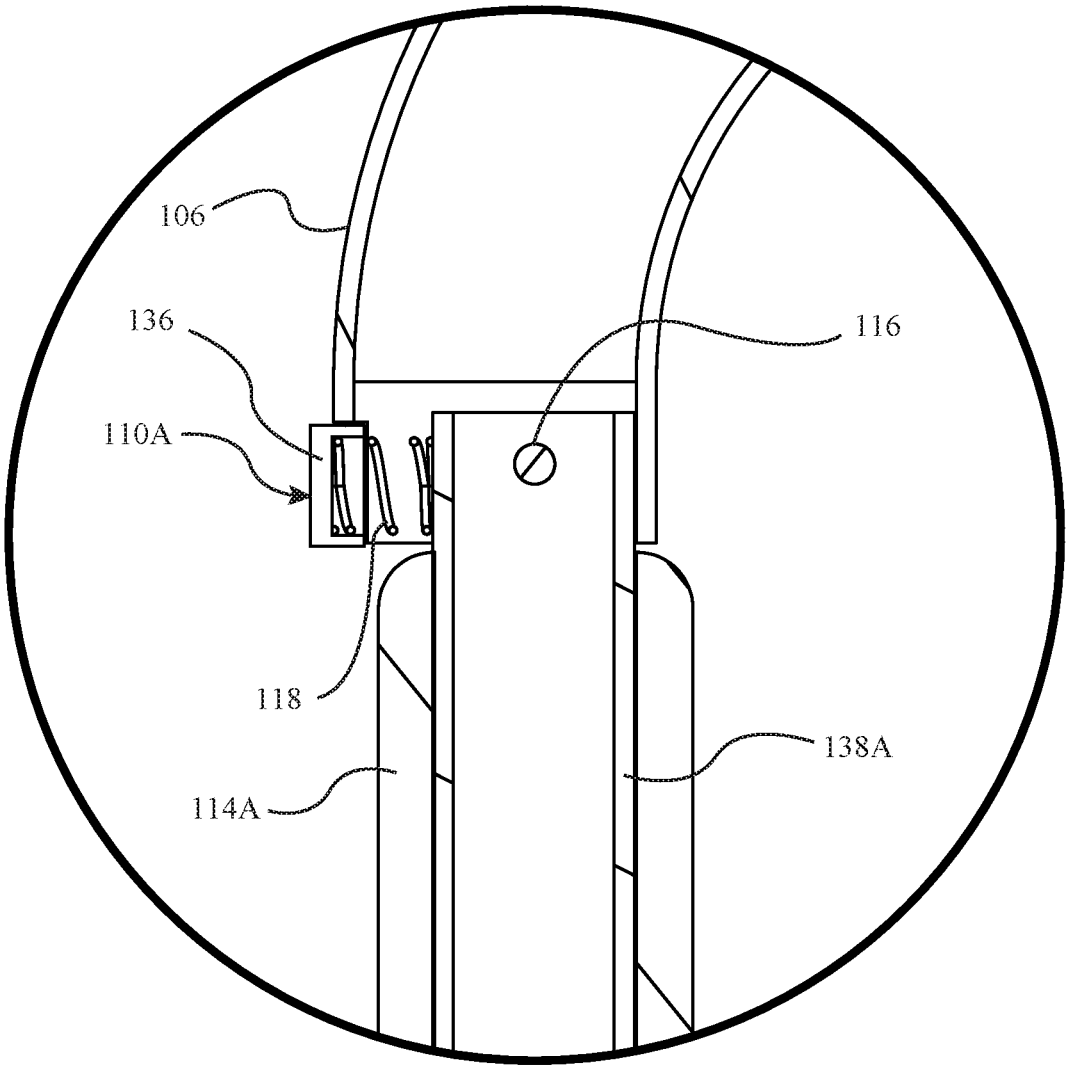
FIG. 13 is an enlarged view of a retention element portion of the example aquatic exercise device depicted in FIG. 1 (Detail "A"), which illustrates an interior of one of the retention elements.

Referring now to FIG. 13, magnified interior portion A of FIG. 12 is illustrated. The upper end of the upper pipe member 138A of tine 108A is hingedly attached to fork root 106 by a fastener 116. In one embodiment, fastener 116 is a brass bolt with a corresponding nut (see FIG. 8). Fastener 116 connects the upper end of tine 108A, 108B to fork root 106 while enabling the lower end of tine 108A to move side to side to accommodate motion of the swimmer (e.g., as diagrammatically indicated by the curved arrows 158A, 158B in FIG. 12). Springs 118 apply normalizing forces to maintain the position of the tine with respect to the fork root 106. The springs 118 are held in place by the retaining plates 136 (see FIGS. 8 and 13). The application of the normalizing forces applied by the springs 118 also act to maintain the position of the swimmer 156 between the tines 108A and 108B when the device 100 is in use (as shown in FIG. 11). During the use of the aquatic exercise device 100 by the swimmer, the device 100 restrains the swimmer 156 at the shoulders, as shown in FIG. 11.

Figure 9:
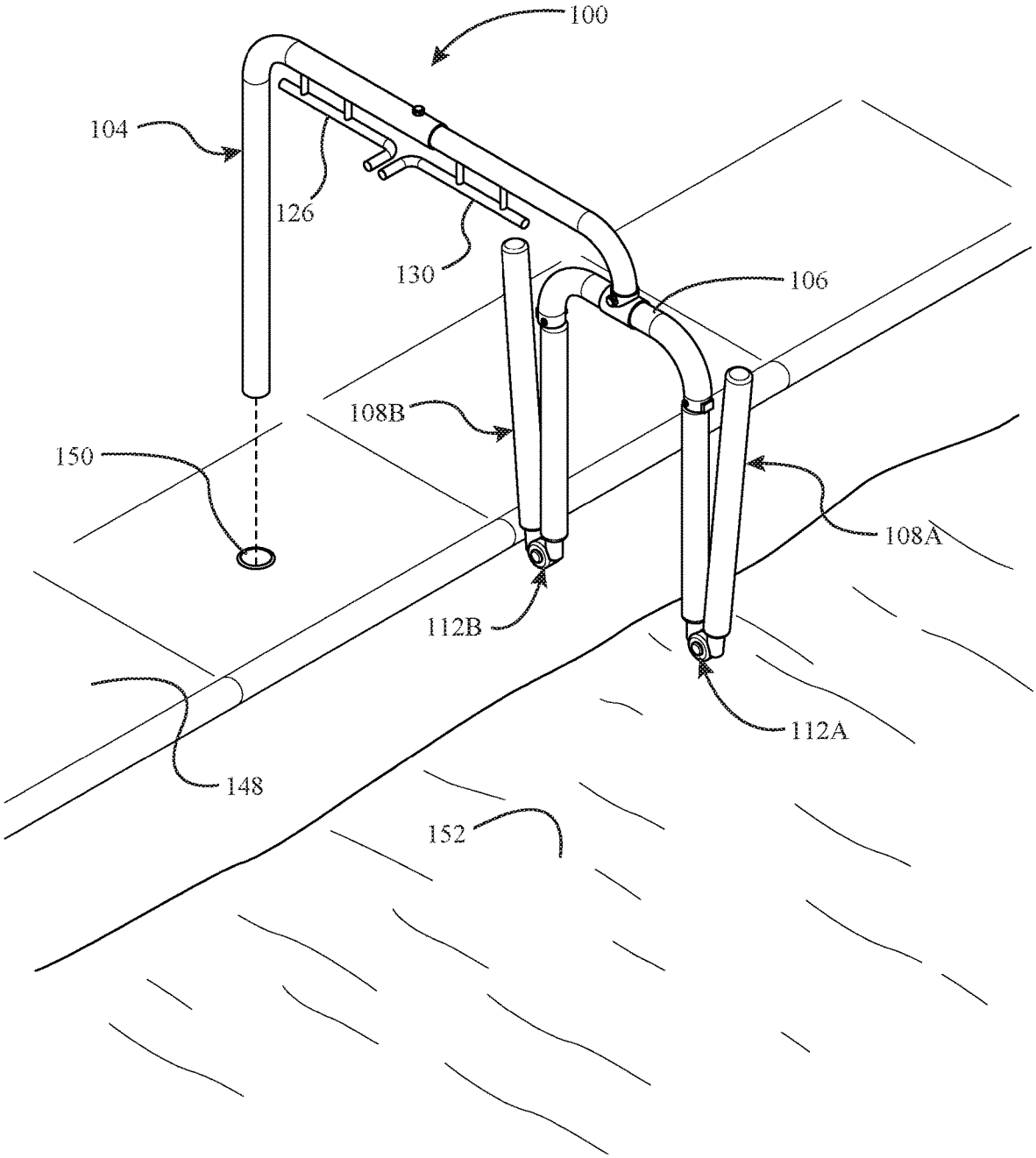
FIG. 9 is another perspective view of the example aquatic exercise device of FIG. 1, wherein the insertion of the aquatic exercise device into a sleeve-type anchor on a pool deck is illustrated.
Figure 16:
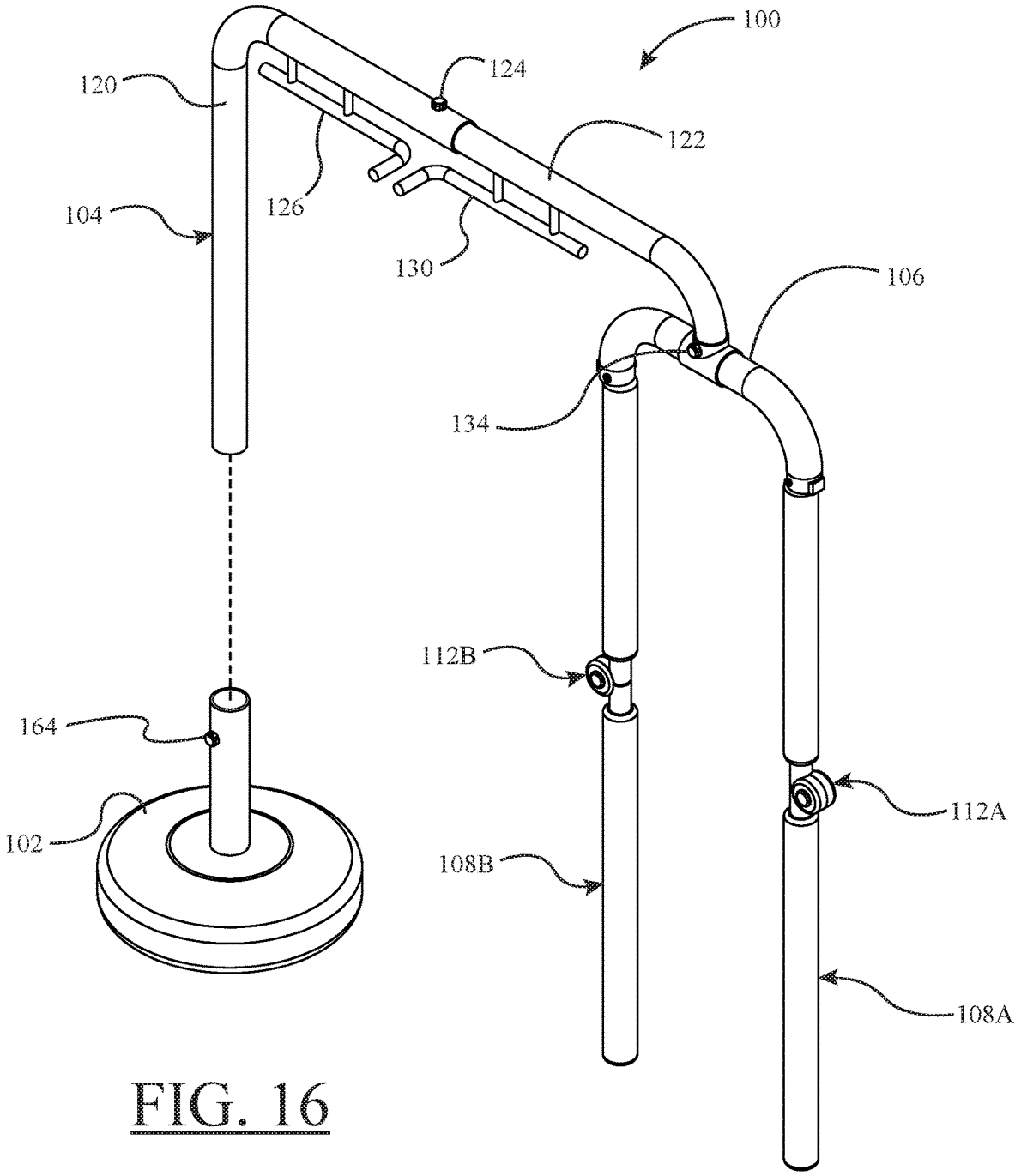
FIG. 16 is still another perspective view of the example aquatic exercise device of FIG. 1, wherein the insertion of the aquatic exercise device into a sleeve member of a base is illustrated.

The aquatic exercise device 100 described herein is particularly useful in a small pool (e.g., a small above-ground pool) because such a pool is not large enough for a swimmer to complete laps across the pool. Although, if the aquatic exercise device 100 described herein were used in this pool, a swimmer could still perform swimming exercises in this small pool by swimming in place while being restrained at the shoulders by the device 100 (as shown in FIG. 11). FIG. 16 depicts an embodiment of the aquatic exercise device 100 described herein, wherein the aquatic exercise device 100 is provided with a portable base 102 that rests upon the pool deck of an in-ground pool. FIGS. 9, 10, and 11 depict the manner in which the suspension element 104 of the aquatic exercise device 100 could alternatively be mounted to a pool deck 148 using a sleeve-type anchor 150, rather than using the portable base 102 depicted in FIG. 16.

Figure 17:
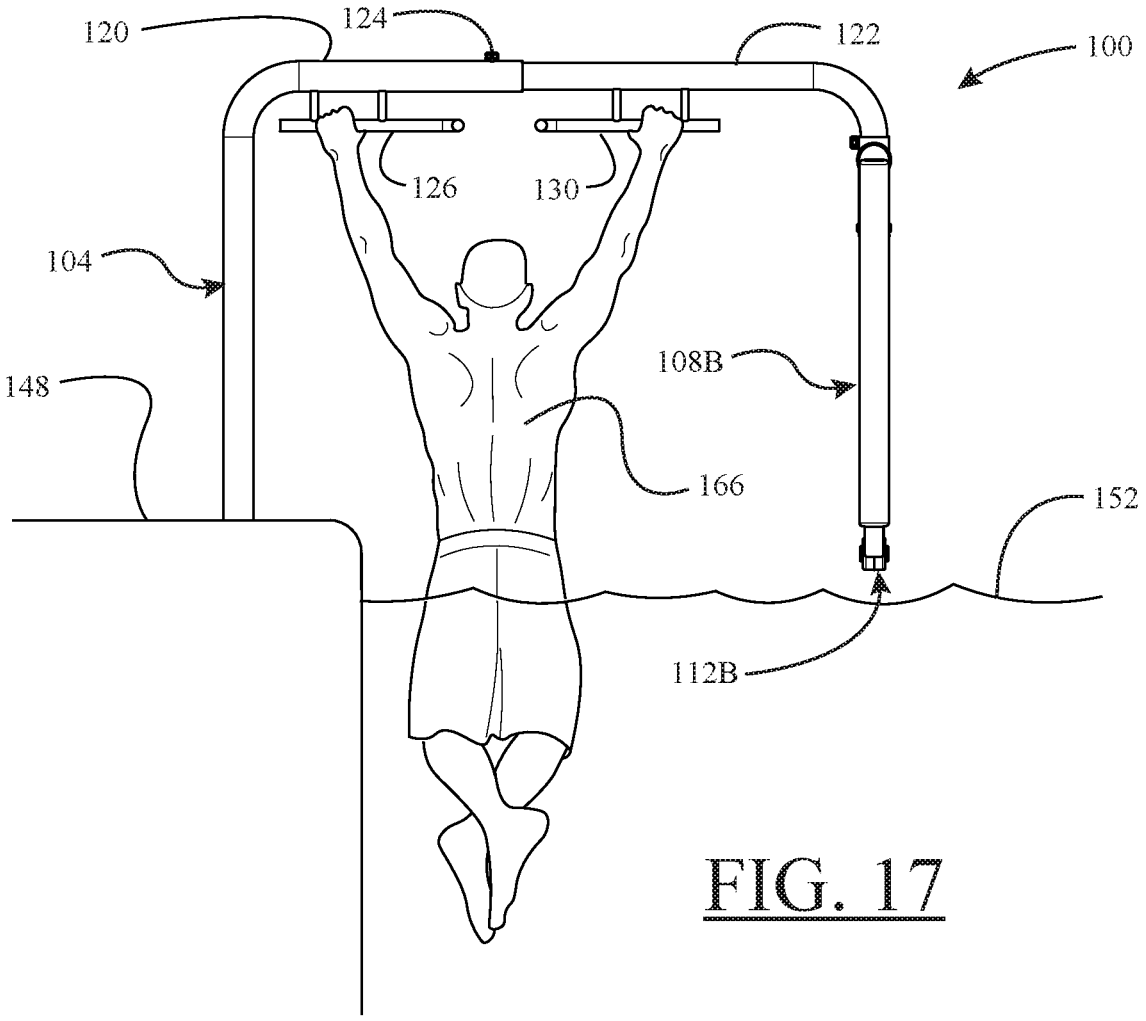
FIG. 17 is a front side view of the example aquatic exercise device of FIG. 1 mounted to a pool deck, wherein a user of the example aquatic exercise device is performing pull-up exercises using the pull-up bars provided on the suspension element of the example aquatic exercise device.

In addition to being used for swimming in place, the aquatic exercise device 100 described herein may be advantageously used for other activities in the pool as well. For example, with combined reference to FIGS. 1 and 17, in the illustrative embodiment, the suspension element 104 of the aquatic exercise device 100 is provided with first and second pull-up bars 126, 130 attached to the underside thereof so as to allow a user 166 to perform pull-up exercises in the pool (see FIG. 17). As best shown in FIG. 1, the first and second pull-up bars 126, 130 may have respective first and second open ends 128, 132 that could be used to accommodate other accessories that may be used with the device 100. For example, a dip station for dipping exercises or a pool basketball hoop could be supported from the first and second open ends 128, 132 of the first and second pull-up bars 126, 130. Also, accessories, such as the dip station or pool basketball hoop, could be attached to other parts of the aquatic exercise device 100 so that it can be used as a multi-station device.

While the devices, systems, methods, and so on have been illustrated by describing examples, and while the examples have been described in considerable detail, it is not the intention of the applicant to restrict, or in any way, limit the scope of the appended claims to such detail. It is, of course, not possible to describe every conceivable combination of components or methodologies for purposes of describing the devices, systems, methods, and so on provided herein. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's general inventive concept. Thus, this application is intended to embrace alterations, modifications, and variations that fall within the scope of the appended claims. The preceding description is not meant to limit the scope of the invention. Rather, the scope of the invention is to be determined by the appended claims and their equivalents.

Finally, to the extent that the term "includes" or "including" is employed in the detailed description or the claims, it is intended to be inclusive in a manner similar to the term "comprising," as that term is interpreted when employed as a transitional word in a claim. Furthermore, to the extent that the term "or" is employed in the claims (e.g., A or B) it is intended to mean "A or B or both." When the applicants intend to indicate "only A or B, but not both," then the term "only A or B but not both" will be employed. Similarly, when the applicants intend to indicate "one and only one" of A, B, or C, the applicants will employ the phrase "one and only one." Thus, use of the term "or" herein is the inclusive, and not the exclusive use. See Bryan A. Garner, A Dictionary of Modern Legal Usage 624 (2d. Ed. 1995).

What is claimed is:

1. An aquatic exercise device for assisting a swimmer to practice swimming in place, said device comprising:

a pair of tines, each tine comprising an upper end and a lower end, and each tine further comprising a hinge, whereby each hinge enables each tine to be folded so that the lower end of each tine is elevated with respect to the upper end;

a fork root attached to the upper ends of the pair of tines;

a suspension element attached to and suspending the fork root; and whereby the suspension element suspends the fork root and the upper ends of the tines above water comprising a practice area, the lower ends of the tines are submerged in the water of the practice area, and the pair of tines operative to maintaining a position of the swimmer in the practice area.

2. The aquatic exercise device according to claim 1, further comprising a base attached to the suspension element.

3. The aquatic exercise device according to claim 1, further comprising a base that is removably attached to the suspension element.

4. The aquatic exercise device according to claim 1, further comprising a base attached to the suspension element, and whereby the suspension element is rotatable with respect to the base.

5. The aquatic exercise device according to claim 1, further comprising a pair of retention elements, and whereby each tine is attached to the fork root using one of the retention elements, and whereby each retention element applies a normalizing force to maintain the position of the tine with respect to the fork root.

6. The aquatic exercise device according to claim 1, further comprising a pair of protective coverings, and wherein each protective covering is applied to of the tines.

7. An aquatic exercise device for assisting a swimmer to practice swimming in place, said device comprising:

a pair of tines, each tine comprising an upper end and a lower end;

a pair of retention elements, the retention elements respectively attached to the upper ends of the tines;

a fork root attached to the upper ends of the pair of tines using the respective retention elements;

a suspension element attached to and suspending the fork root; and whereby the suspension element suspends the fork root and the upper ends of the tines above water comprising a practice area, the lower ends of the tines are submerged in the water of the practice area, the pair of tines operative to maintaining a position of the swimmer in the practice area, and each retention element applies a normalizing force to maintain the position of each tine with respect to the fork root.

8. The aquatic exercise device according to claim 7, further comprising a base attached to the suspension element.

9. The aquatic exercise device according to claim 7, further comprising a base that is removably attached to the suspension element.

10. The aquatic exercise device according to claim 7, further comprising a base attached to the suspension element, and whereby the suspension element is rotatable with respect to the base.

11. The aquatic exercise device according to claim 7, wherein each tine comprises a hinge, whereby each hinge enables each tine to be folded so that the lower end of each tine is elevated with respect to the upper end.

12. The aquatic exercise device according to claim 7, further comprising a pair of protective coverings, and wherein each protective covering is applied to one of the tines.

13. An aquatic exercise device for assisting a swimmer to practice swimming in place, said device comprising:

a pair of tines, each tine comprising an upper end and a lower end;

a pair of retention elements, the retention elements respectively attached to the upper ends of the tines;

a fork root attached to the upper ends of the pair of tines using the respective retention elements;

a suspension element comprising a first end and a second end, the suspension element attached to and suspending the fork root at the first end of the suspension element;

a base attached to the second end of the suspension element; and whereby the suspension element suspends the fork root and the upper ends of the tines above water comprising a practice area, the lower ends of the tines are submerged in the water of the practice area, the pair of tines operative to maintaining a position of the swimmer in the practice area, and each retention element applies a normalizing force to maintain the position of each tine with respect to the fork root.

14. The aquatic exercise device according to claim 13, wherein the base is removably attached to the suspension element.

15. The aquatic exercise device according to claim 13, wherein the suspension element is rotatable with respect to the base.

16. The aquatic exercise device according to claim 13, wherein each tine comprises a hinge, whereby each hinge enables each tine to be folded so that the lower end of each tine is elevated with respect to the upper end.

17. The aquatic exercise device according to claim 13, further comprising a pair of protective coverings, and wherein each protective covering is applied to one of the tines.

18. An aquatic exercise device for assisting a swimmer to practice swimming in place, said device comprising:

a pair of tines, each tine comprising an upper end and a lower end;

a fork root attached to the upper ends of the pair of tines;

a suspension element attached to and suspending the fork root; and whereby the suspension element suspends the fork root and the upper ends of the tines above water comprising a practice area, the lower ends of the tines are submerged in the water of the practice area, each of the tines extending vertically downward into the water, a first one of the tines being horizontally spaced apart from a second one of the tines so as to define a gap therebetween that is configured to receive a neck of the swimmer, and the pair of tines operative to maintaining a position of the swimmer in the practice area by restraining the swimmer at his or her shoulders.

* * * * *